US006648544B2

(12) United States Patent
Liu

(10) Patent No.: US 6,648,544 B2
(45) Date of Patent: Nov. 18, 2003

(54) CONNECTOR FOR GLASS

(75) Inventor: Chih-Liang Liu, Taipei (TW)

(73) Assignee: Chan Hong Enterprise Co., Ltd., Taipei (TW)

( * ) Notice: Subject to any disclaimer, the term of this patent is extended or adjusted under 35 U.S.C. 154(b) by 130 days.

(21) Appl. No.: 10/013,440

(22) Filed: Dec. 8, 2001

(65) Prior Publication Data

US 2003/0108386 A1 Jun. 12, 2003

(51) Int. Cl.[7] ..... E05D 7/10

(52) U.S. Cl. ..... 403/408.1; 403/374.3; 16/221

(58) Field of Search ..... 403/374.1, 374.2, 403/374.3, 408.1, 343, 187, 188, 52, 230, 240, 241, 247, 256, 257, 258; 16/229, 221

(56) References Cited

U.S. PATENT DOCUMENTS

| | | | | | |
|---|---|---|---|---|---|
| 5,297,313 | A | * | 3/1994 | Brin | 16/252 |
| 5,613,276 | A | * | 3/1997 | Franz | 16/229 |
| 2002/0066161 | A1 | * | 6/2002 | Chiang | 16/284 |

* cited by examiner

*Primary Examiner*—John R. Cottingham

(57) ABSTRACT

A connector for a piece of glass has a main post and a secondary post securely connected to the main post. The main post is adapted to be connected a top hinge and a bottom hinge of a glass door, a revolving door, a casement or a paravent. The secondary post is able to secure the piece of glass.

12 Claims, 10 Drawing Sheets

CONNECTOR FOR GLASS

FIELD OF THE INVENTION

The present invention relates to a connector, and more particularly to a connector for glass. With the connector, glass is combined to be a revolving door, a paravent or a casement.

BACKGROUND OF THE INVENTION

Glass is largely used in doors or screens and all these applications of glass required special designed connectors. Each of these connectors is designed to have only one special application, that is, a specially designed connector applies only to a specific function. There is no room of substitution of these connectors. Therefore, users will have to prepare a lot of different connectors for different applications. Furthermore, these connectors are complex in structure and difficult in mounting. As a consequence, the cost for these connectors is high.

To overcome the shortcomings, the present invention intends to provide an improved glass connector to mitigate or obviate the aforementioned problems.

SUMMARY OF THE INVENTION

The primary objective of the invention is to provide a connector for glass. The connector is simple in structure and easy to be implemented.

In order to accomplish the foregoing objective, the connector of the present invention has a main post and a secondary post securely connected to the main post. The main post is adapted to be connected a top hinge and a bottom hinge of a glass door, a revolving door, a casement or a paravent.

Other objects, advantages and novel features of the invention will become more apparent from the following detailed description when taken in conjunction with the accompanying drawings.

DETAILED DESCRIPTION OF THE INVENTION

Figure 1:
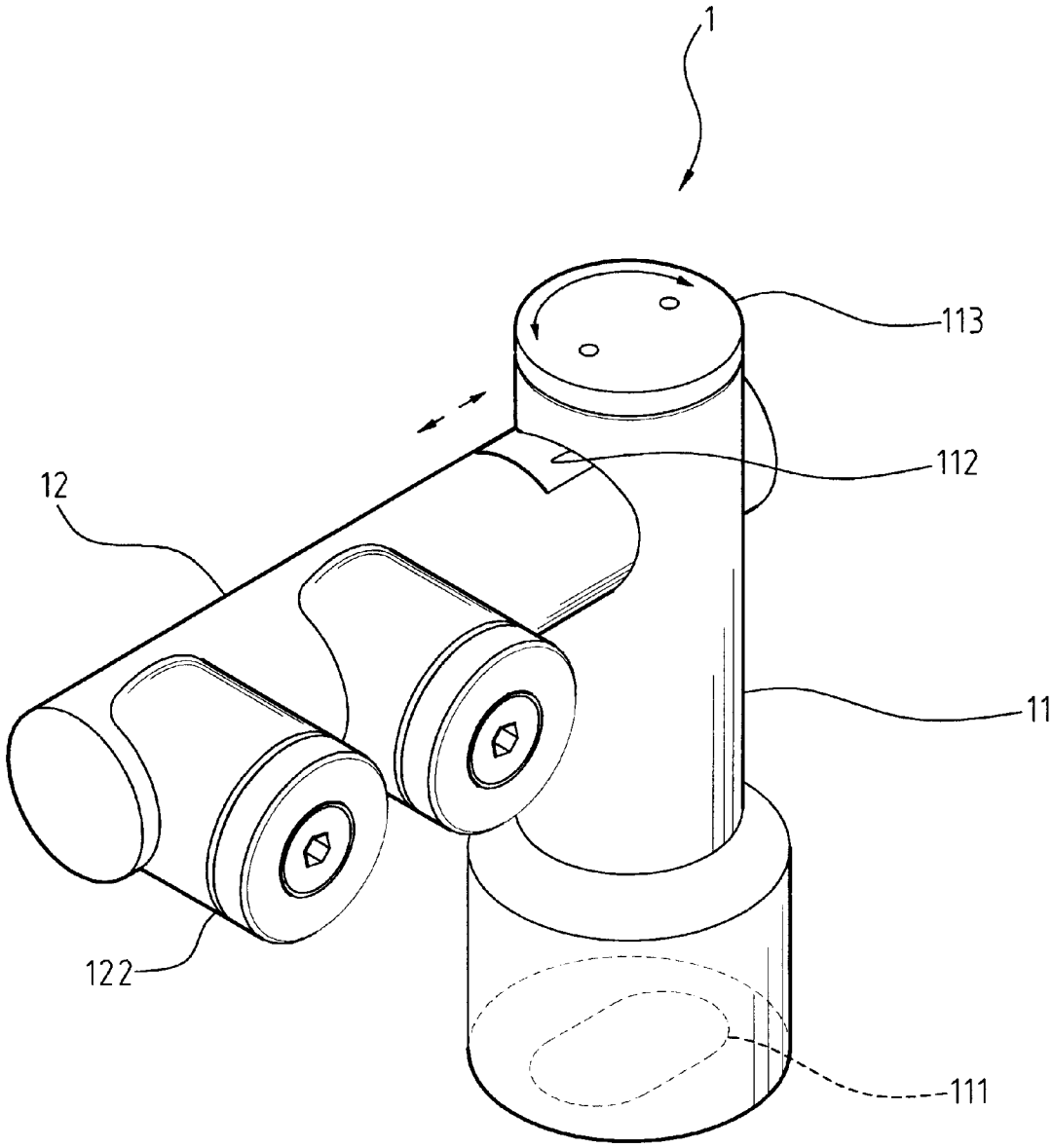
FIG. 1 is a perspective view of the connector of the present invention.
Figure 2:
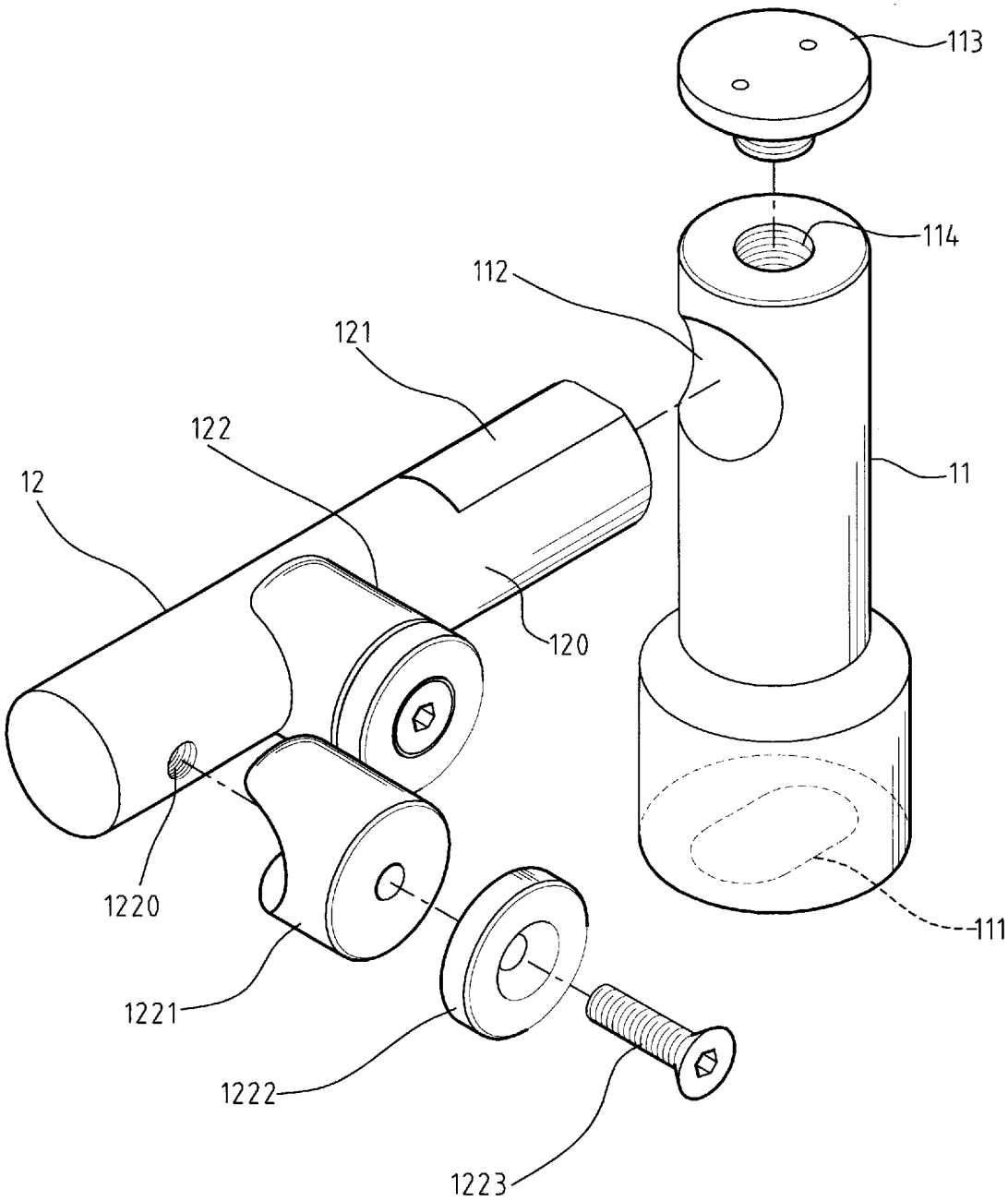
FIG. 2 is an exploded perspective view of the connector in FIG. 1.
Figure 3:
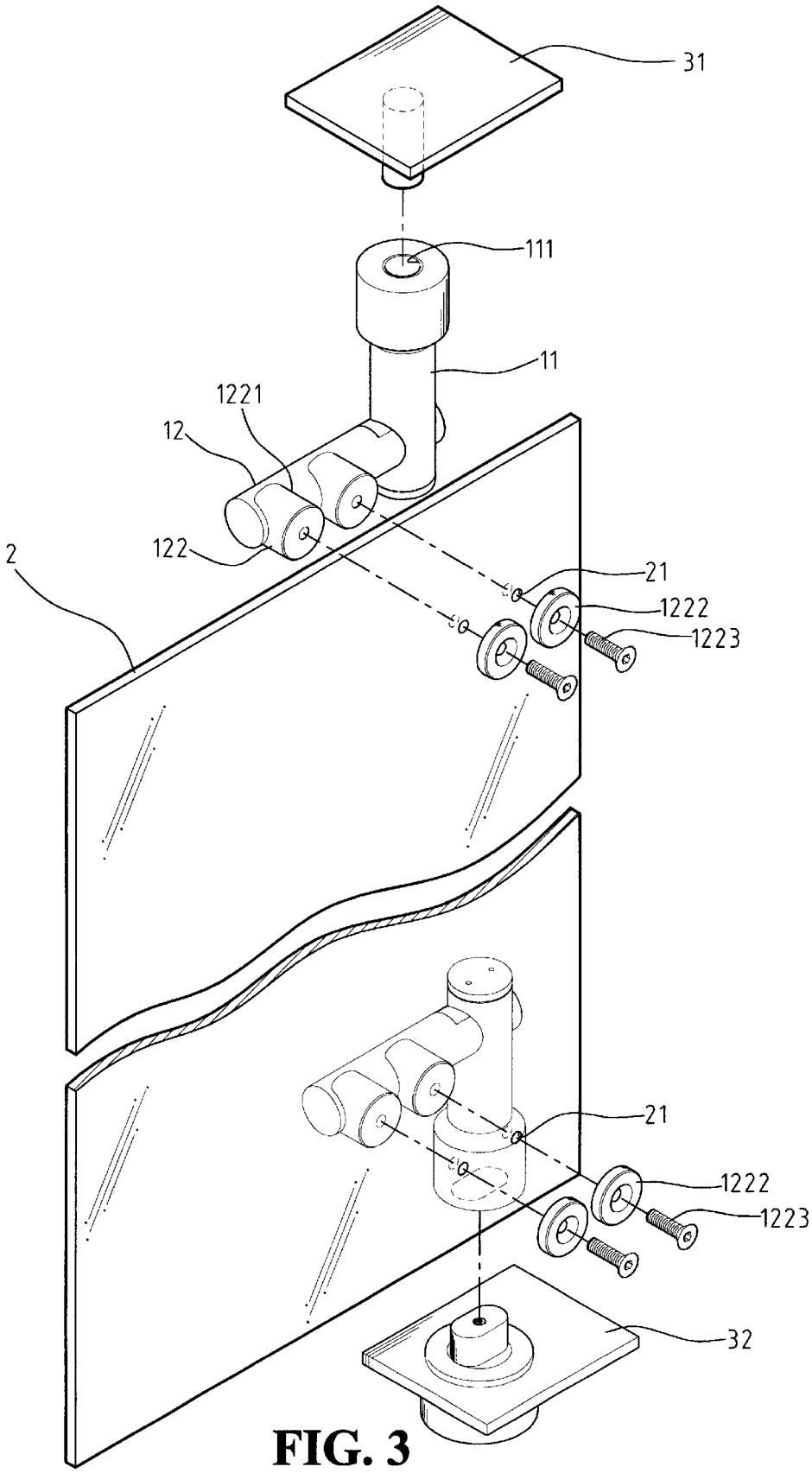
FIG. 3 is a schematic view of the connector, wherein the connector is implemented to secure a glass door.

With reference to FIGS. 1, 2 and 3, the connector 1 in accordance with the present invention has a main post 11 and a secondary post 12.

The main post 11 has a bottom hole 111 defined in one end of the main post 11 to adapt to a hinge 32 of a glass sheet 2. A side hole 112 is defined in a periphery of the main post 11. A top hole 114 is defined in another end of the main post 11 to threadingly receive therein a bolt 113.

The secondary post 12 has a connecting end 120 with a plan face 121 formed on a periphery of the secondary post 12 and at least one (two are shown in this preferred embodiment) securing unit 122 secured to the periphery of the secondary post 12. Each securing unit 122 includes a first connector 1221, a second connector 1222 and a securing bolt 1223. The securing bolt 1223 extends through the second and first connector 1221,1222 so as to threadingly engage with a threaded hole 1220 in the periphery of the secondary post 12.

When the connector in FIG. 1 is implemented to secure glass sheet (as shown in FIG. 3), two main posts 11 are used to respectively engage with a top hinge 31 and a bottom hinge 32 of the glass sheet 2 by inserting the top and bottom hinges 32 of the glass sheet 2 into the bottom holes 111. The connecting end 120 is inserted into the side hole 112 and the bolt 113 is threadingly inserted into the top hole 114 to engage with the plan face 121 so as to secure the secondary post 12 in the main post 11. Then the first connector 1221 of the at least one securing unit 122 is first attach to the periphery of the secondary post 12 and the glass sheet 2 attach to the first connector 1221 with holes 21 in the glass sheet 2 aligned with holes (not numbered) in the first connector 1221. Thereafter, the securing bolt 1223 extends through the second connector 1222, the holes 21, the first connector 1221 and into the threaded hole 1220 to thereby secure the glass sheet 2 with the connector 1 of the present invention.

Figure 4:
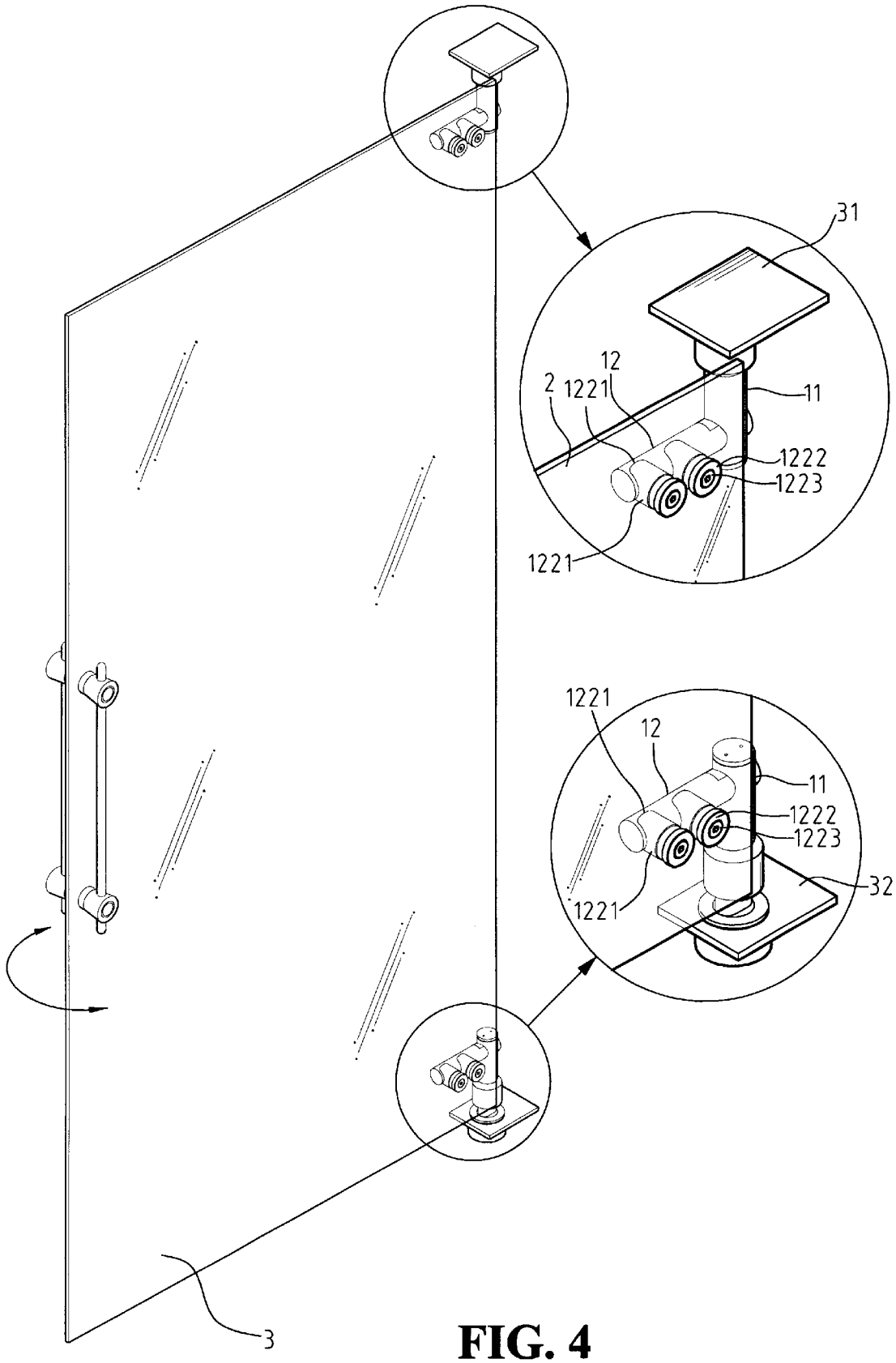
FIG. 4 is a perspective view showing that two connectors are mounted to secure a glass door.

With reference to FIG. 4, when the glass sheet is a glass door 3, with the connector 1 of the present invention, the glass door is able to securely and smoothly pivot about the top and bottom hinges 31,32.

Figure 5:
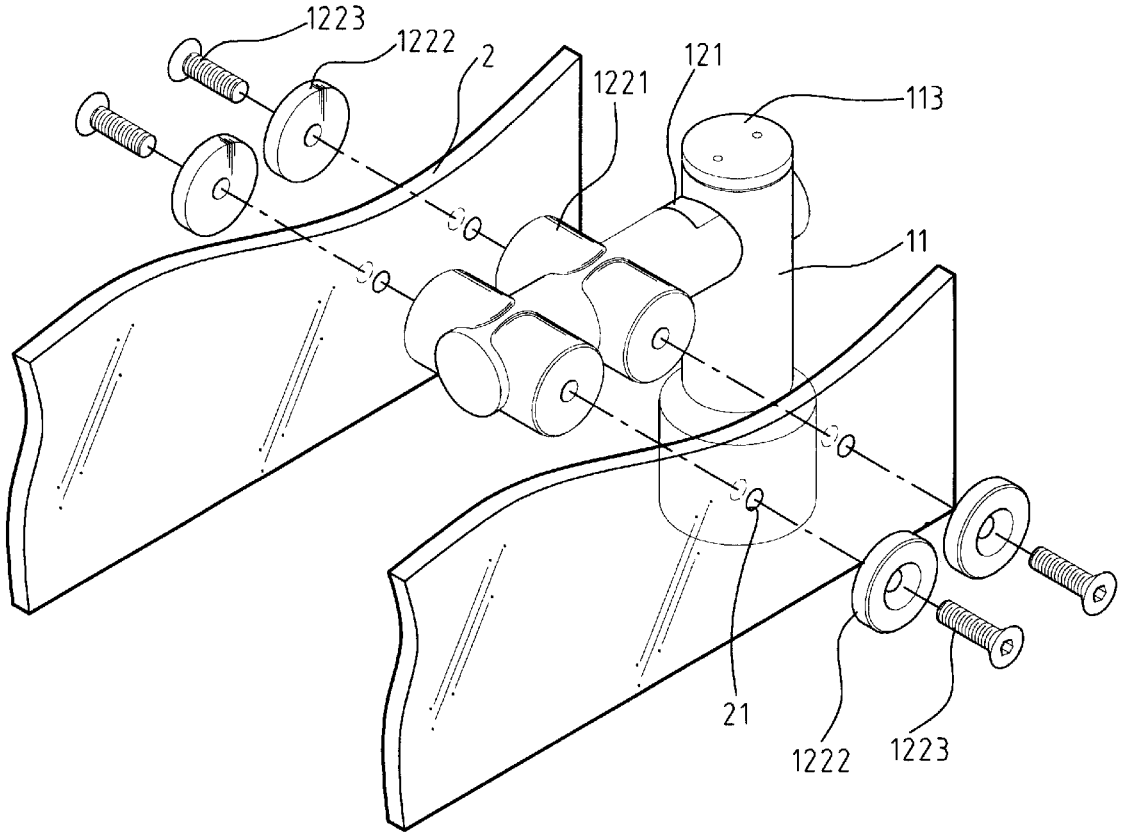
FIG. 5 is an exploded perspective view of another embodiment of the connector of the present invention.
Figure 6:
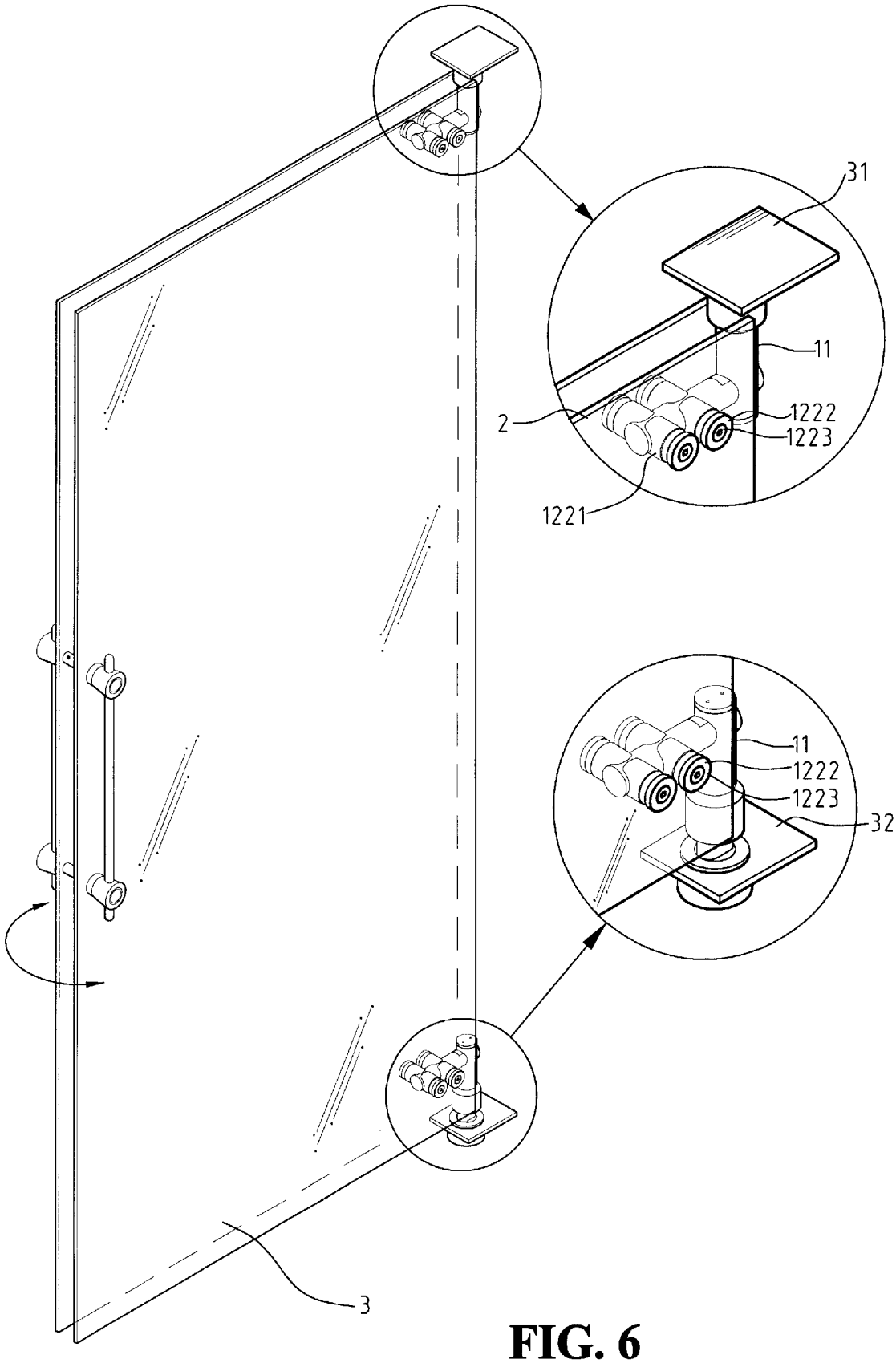
FIG. 6 is a schematic view of the connector in FIG. 5, wherein the connector is used to secure a glass door with two layers of glasses.

With reference to FIGS. 5 and 6, a second preferred embodiment of the present invention is shown. The connector as shown has two pairs of securing units 122 on the secondary post 12. The two pairs of securing units 122 are correspondingly formed on the secondary post 12. That is, each securing unit 122 has another securing unit 122 close by and still another securing unit 122 on the opposite side of the secondary post 12. With the arrangement of the connector 2 of the present invention, two glass sheets 2 are able to be simultaneously secured by the connector 2 so that the user is able to work on the two-layer glass door 3 to increase attractions.

Figure 7:
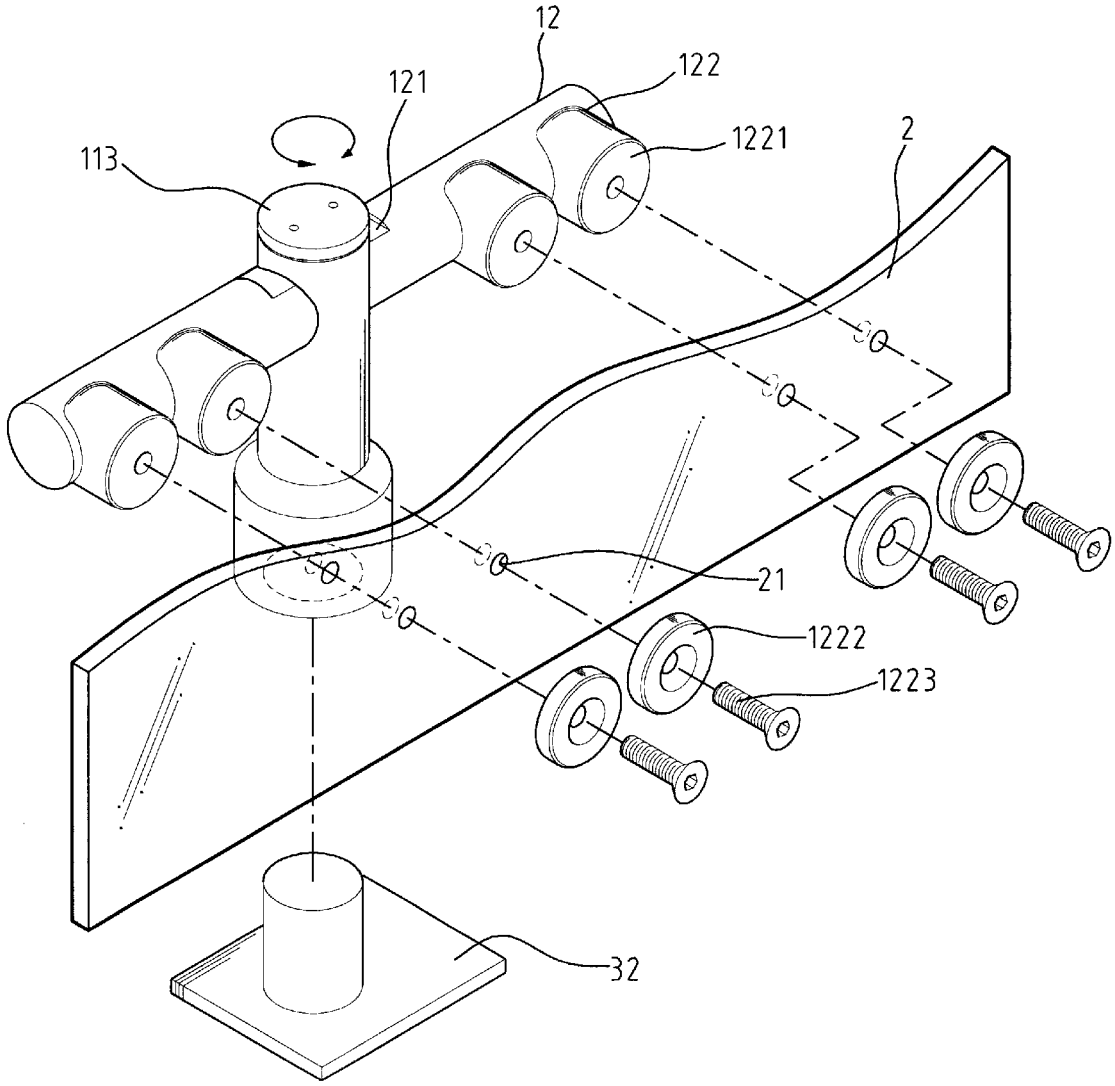
FIG. 7 is an exploded perspective view of still another embodiment of the connector of the present invention.
Figure 8:
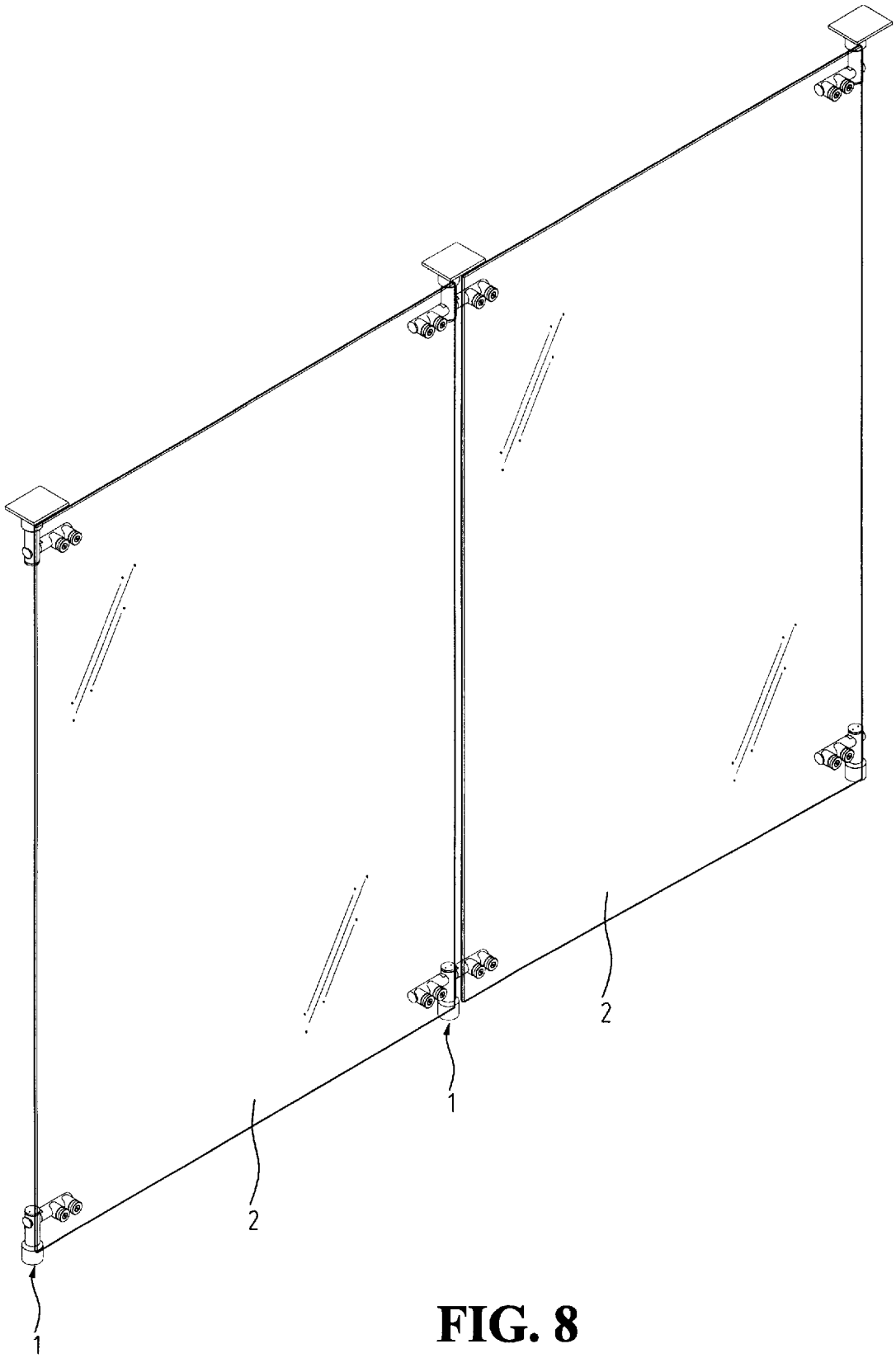
FIG. 8 is a schematic view of the connector in FIG. 7, wherein the connector is used to secure a paravent.

With reference to FIGS. 7 and 8, the connector of the present invention has two secondary posts 12 each having at least one (two are shown in this embodiment) securing unit 122. Each at least one securing unit 122 on one secondary post 12 may be formed on the same side as another on the other secondary post 12 so that the connector 1 is able to function as a joint to secure two glass sheets 2.

Figure 9A:
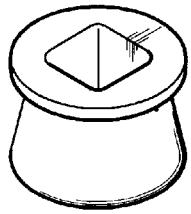
FIG. 9 is an exploded perspective view of the main post.
Figure 9B:
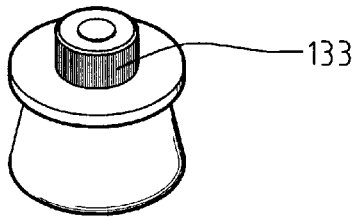
Figure 9C:
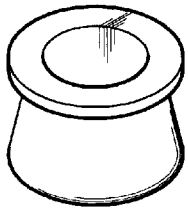
Figure 9:
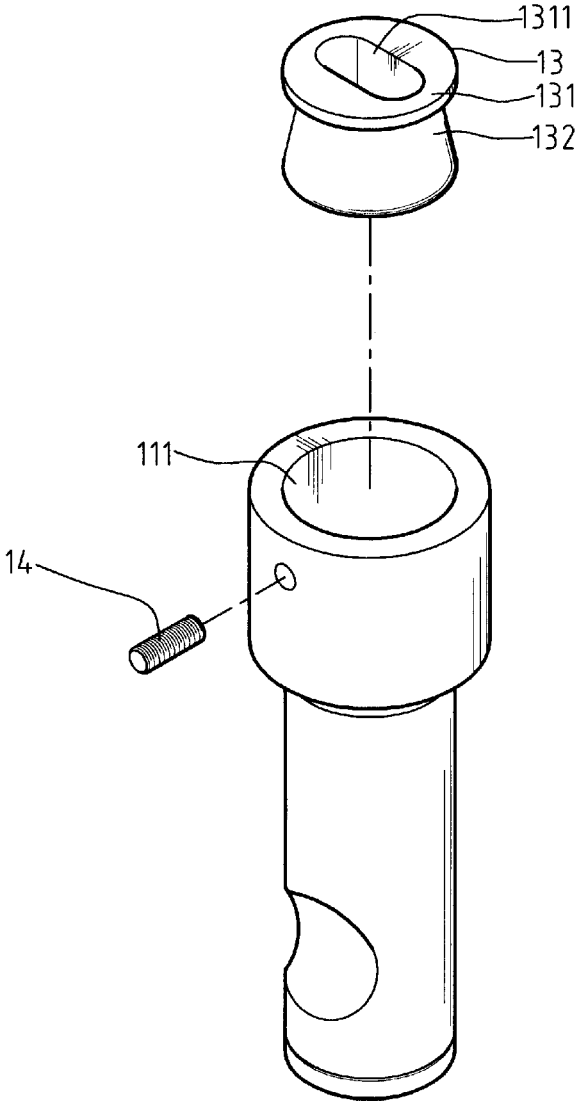
Figure 10:
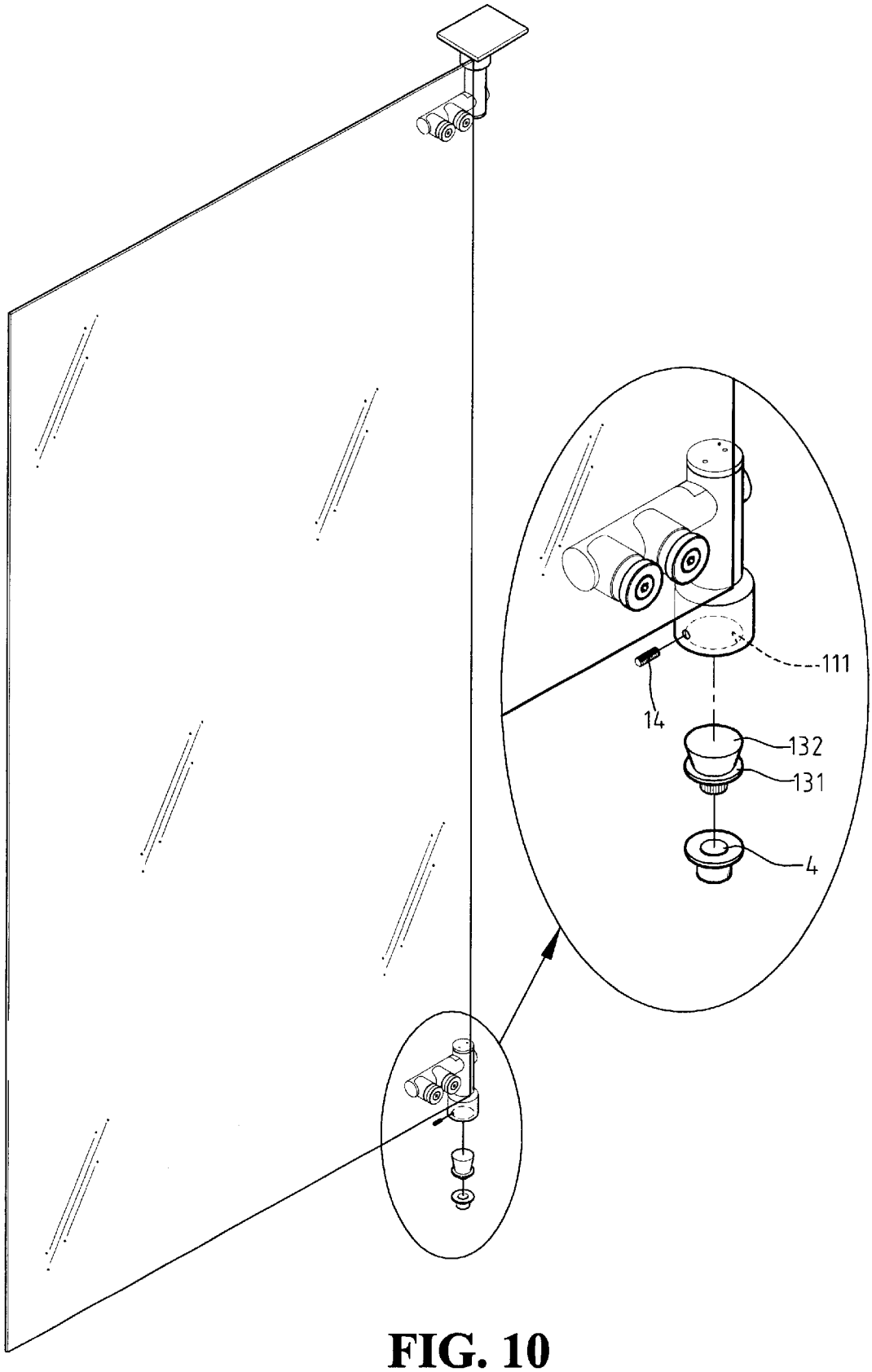
FIG. 10 is a schematic view of the connector in FIG. 9, wherein the connector is used to adapt to a different type of hinge of a glass door.

With reference to FIGS. 9 and 10, still another preferred embodiment of the present invention is shown. The connector of this embodiment has an auxiliary seat 13 with a flange 131, a truncated conical bottom 132 securely formed on a side of the flange 131 and a channel 1311 defined to communicate with the bottom hole 111 of the main post 11. The truncated conical bottom 132 is able to be received in the bottom hole 111 and secured in the bottom hole 111 by a bolt 14 extending through the periphery of the main post 11. Due to the conical shape of the truncated conical bottom 132, the bolt 14 is able to securely retain the auxiliary seat 13 in the bottom hole 111. After the auxiliary seat 13 is secured in the bottom hole 111 in the main post 11, the shape of the channel 1311 is able to be designed to any shape to adapt to the top or bottom hinge 31,32, as shown in FIGS. 9A and 9B, wherein the shape of the channel 1311 may be a round or a square one. Again, an extension 133 may be formed on top of the flange 131 to cope with a nut like cap 4 so as to be received in the bottom hinge 32 of the glass sheet 2.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector for a piece of glass, the connector comprising:

a main post having a bottom hole defined in one end of the main post to adapt to a hinge of the piece of glass sheet, a side hole defined in a periphery of the main post, a top hole defined in another end of the main post to threadingly receive therein a bolt;

at least one secondary post having a connecting end inserted into and secured in the side hole by the bolt, the at least one secondary post provided with a plan face formed on a periphery of the secondary post to be engaged with the bolt and at least one securing unit secured on the periphery of the secondary post, each securing unit including a first connector attached to the periphery of the secondary post, a second connector and a securing bolt, wherein the securing bolt extends through the second and first connector so as to threadingly engage with a threaded hole in the periphery of the secondary post and the piece of glass is secured between the first and second connector.

2. The connector as claimed in claim 1, wherein the secondary post has two securing units formed on one side of the periphery of the secondary post.

3. The connector as claimed in claim 1, wherein the secondary post has two pairs of securing units each pair formed on one side of the periphery of the secondary post and corresponding to the other pair of securing unit.

4. The connector as claimed in claim 1, wherein the main post has two secondary posts each extending in opposite direction and having at least one securing unit formed on the periphery of the secondary post.

5. The connector as claimed in claim 2, wherein the main post has two secondary posts each extending in opposite direction and having at least one securing unit formed on the periphery of the secondary post.

6. The connector as claimed in claim 3, wherein the main post has two secondary posts each extending in opposite direction and having at least one securing unit formed on the periphery of the secondary post.

7. The connector as claimed in claim 1, wherein the main post has an auxiliary seat received in the top hole and provided with a flange, truncated conical bottom formed on one side of the flange and a channel defined to communicate with the top hole so that the main post is able to be adapted to secure with the hinge of the piece of glass.

8. The connector as claimed in claim 2, wherein the main post has an auxiliary seat received in the top hole and provided with a flange, truncated conical bottom formed on one side of the flange and a channel defined to communicate with the top hole so that the main post is able to be adapted to secure with the hinge of the piece of glass.

9. The connector as claimed in claim 3, wherein the main post has an auxiliary seat received in the top hole and provided with a flange, truncated conical bottom formed on one side of the flange and a channel defined to communicate with the top hole so that the main post is able to be adapted to secure with the hinge of the piece of glass.

10. The connector as claimed in claim 4, wherein the main post has an auxiliary seat received in the top hole and provided with a flange, truncated conical bottom formed on one side of the flange and a channel defined to communicate with the top hole so that the main post is able to be adapted to secure with the hinge of the piece of glass.

11. The connector as claimed in claim 5, wherein the main post has an auxiliary seat received in the top hole and provided with a flange, truncated conical bottom formed on one side of the flange and a channel defined to communicate with the top hole so that the main post is able to be adapted to secure with the hinge of the piece of glass.

12. The connector as claimed in claim 6, wherein the main post has an auxiliary seat received in the top hole and provided with a flange, truncated conical bottom formed on one side of the flange and a channel defined to communicate with the top hole so that the main post is able to be adapted to secure with the hinge of the piece of glass.

* * * * *